US006050706A

United States Patent [19]

Ohtuka et al.

[11] Patent Number: 6,050,706

[45] Date of Patent: Apr. 18, 2000

[54] VEHICLE TURN SIGNAL LAMP HAVING LIGHT BULB COVERED WITH TRANSPARENT CAP AND TRANSPARENT LENS FOR ENHANCING VEHICLE LAMP APPEARANCE

[75] Inventors: Yasushi Ohtuka; Masataka Chouji; Naoki Kakiuchi, all of Shizuoka, Japan

[73] Assignee: Koito Manufacturing Co., Ltd., Tokyo, Japan

[21] Appl. No.: 08/951,678

[22] Filed: Oct. 16, 1997

[30] Foreign Application Priority Data

Oct. 17, 1996 [JP] Japan ..... 8-295672

[51] Int. Cl.[7] ..... F21V 7/00

[52] U.S. Cl. ..... 362/308; 362/293; 362/294; 362/310; 362/311; 362/327; 362/333; 362/335; 362/336; 362/337; 362/338; 362/510; 362/517; 362/518; 362/520; 362/521; 362/522

[58] Field of Search ..... 362/293, 294, 362/308, 310, 311, 327, 333, 335, 336, 337, 338, 510, 517, 518, 520, 521, 522

[56] References Cited

U.S. PATENT DOCUMENTS

| | | | |
|---|---|---|---|
| 4,042,818 | 8/1977 | Green | 240/41 |
| 4,366,407 | 12/1982 | Walsh | 313/112 |
| 4,868,725 | 9/1989 | Sakagawa et al. | 362/231 |
| 5,251,111 | 10/1993 | Nagengast et al. | 362/61 |
| 5,287,101 | 2/1994 | Serizawa | 340/815 |
| 5,548,498 | 8/1996 | Murakami | 362/336 |
| 5,582,481 | 12/1996 | Natsume | 362/336 |

*Primary Examiner*—Sandra O'Shea
*Assistant Examiner*—Ronald E. Delgizzi
*Attorney, Agent, or Firm*—Morgan, Lewis & Bockius LLP

[57] ABSTRACT

A vehicle lamp includes an amber light bulb covered with a cup-shaped colorless transparent cap, thus emitting an amber light beam. A colorless, transparent, plain lens is employed. Furthermore, the inner surface of the cylindrical portion of the transparent cap is formed into a plurality of side steps, and the inner surface of the front end portion of the transparent cap is shaped into a Fresnel lens, and the outer surface of the front end portion is shaped into a plurality of fisheye lenses, which makes it more difficult to see the amber light bulb. Therefore, the vehicle lamp appears deep and glittering.

20 Claims, 4 Drawing Sheets

VEHICLE TURN SIGNAL LAMP HAVING LIGHT BULB COVERED WITH TRANSPARENT CAP AND TRANSPARENT LENS FOR ENHANCING VEHICLE LAMP APPEARANCE

BACKGROUND OF THE INVENTION

1. Field of the Invention

This invention relates to a vehicle lamp such as a front turn signal lamp, and, more particularly, to a vehicle lamp with lower contrast and improved appearance.

2. Description of Related Art

In general, a vehicle lamp adapted to emit a colored light beam has a colored lens. On the other hand, a front turn signal lamp or the like emits a colored light beam as follows: a colored (for example, amber) transparent cap is attached to the reflector so that the light bulb is covered, while the lens is colorless and transparent. In this case, the vehicle lamp appears deep and glittering, and the lamp's appearance is improved when it is off.

However, in the above-described conventional vehicle lamp with the colored, transparent cap, the cap and the reflector's reflecting surface (which shines white) have high contrast. Hence, the vehicle lamp is disadvantageous in that, when turned on, the vehicle lamp is not sufficiently attractive in appearance.

On the other hand, if the light bulb is colored, the resultant colored vehicle lamp lens is smaller than a vehicle lamp with a colored, transparent cap. The "colored light bulb" means a light bulb in which a transparent color is on a glass portion of the light bulb so that the light bulb emits the desired color. Therefore, the colored lens using a colored light bulb looks unattractive in appearance. This difficulty cannot be eliminated in that the colored bulb and the reflector's reflecting surface shine with high contrast.

In recent vehicle lamps, there is a tendency to use a lens that is transparent or substantially transparent in order to make the vehicle lamp appear deeper and more glittering. However, in this case, the colored bulb is visible in its entirety or substantially in its entirety. Hence, the difficulty with high contrast is even more significant.

SUMMARY OF THE INVENTION

Accordingly, the present invention is directed to a vehicle lamp that substantially obviates one or more of the problems due to the limitations and disadvantages of the related art.

An object of the present invention is to provide a vehicle lamp designed to emit a colored light beam, which looks attractive in appearance when not turned on.

In one aspect of the present invention there is provided a vehicle lamp including a colored light bulb; a reflector reflecting light emitted from the light bulb; a lens positioned in front of the reflector; a transparent cap attached to the reflector and covering the light bulb, wherein the transparent cap is either colorless or lighter in color than the light bulb; and the transparent cap further including a plurality of lens elements.

It is to be understood that both the foregoing general description and the following detailed description are exemplary and explanatory and are intended to provide further explanation of the invention as claimed.

Additional features and advantages of the present invention will be set forth in the description which follows, and will be apparent from the description, or may be learned by practice of the invention. The objectives and other advantages of the invention will be realized and attained by the structure and process particularly pointed out in the written description as well as in the appended claims.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention.

In the drawings.

DETAILED DESCRIPTION OF THE PREFERRED EMBODIMENTS

Figure 1:
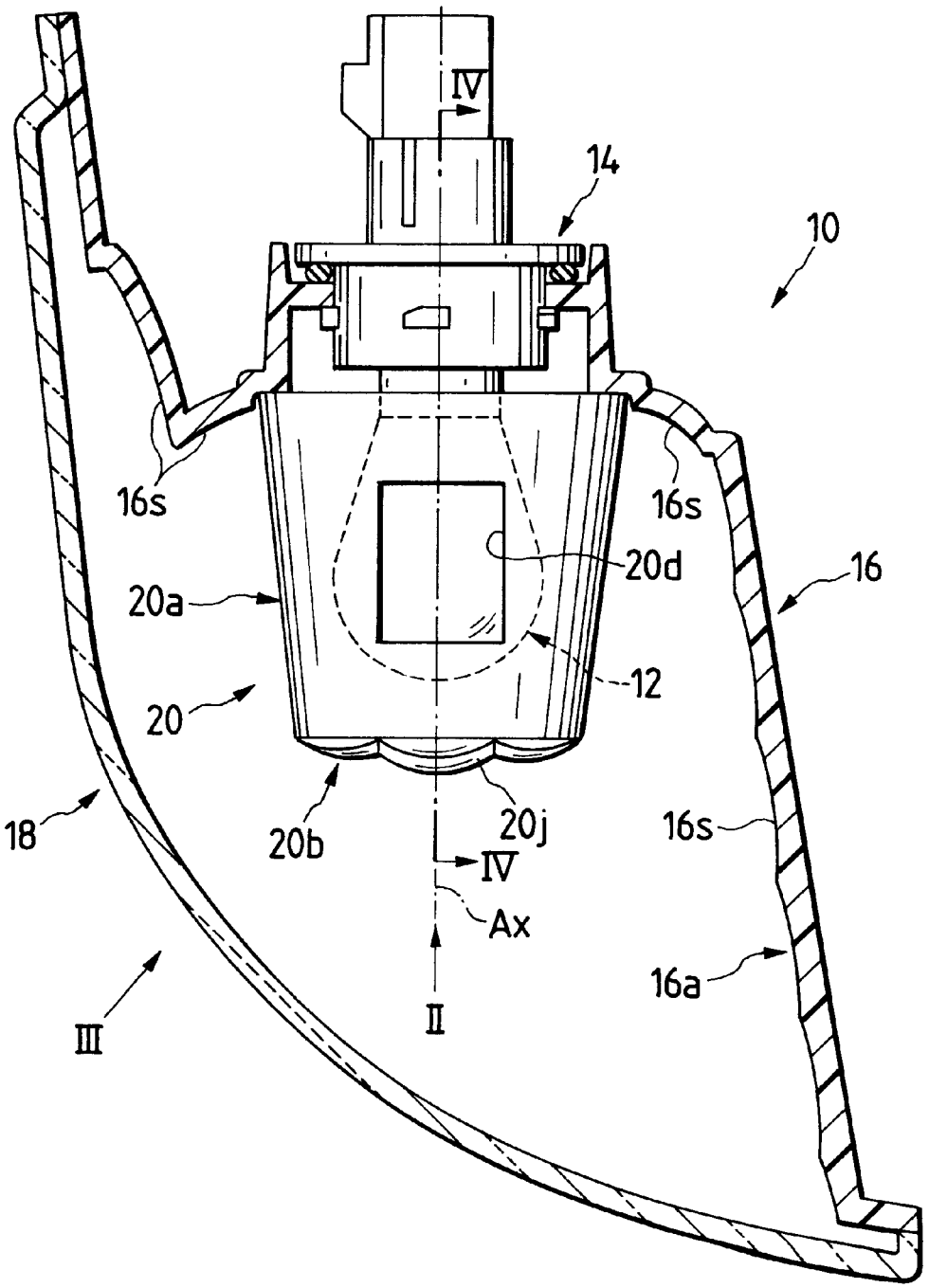
FIG. 1 is a sectional plan view showing a vehicle lamp, which constitutes a preferred embodiment of the invention.

Reference will now be made in detail to the preferred embodiments of the present invention, examples of which are illustrated in the accompanying drawings.

In a vehicle bulb according to the invention, a colored bulb and a colored, transparent cap are employed in combination to achieve the desired effect.

A preferred embodiment of the present invention is a vehicle lamp comprising a light bulb; a reflector adapted to reflect light emitted from the light bulb; and a lens arranged in front of the reflector, to emit a colored light beam, in which the light bulb is a colored light bulb, a transparent cap which is colorless or lighter in color than the light bulb is attached to the reflector in such a manner as to cover the reflector, and the transparent cap includes a plurality of lens elements.

A transparent cap that is lighter in color than a light bulb includes a cap with a color that which is lighter than the color of the light bulb (i.e., the cap is more transparent than the glass of the light bulb). It may be a color that is equal in hue to the color of the light bulb and lighter than the light bulb, or it may be a color that is different in hue from that of the light bulb and lighter than the light bulb.

Lens elements broadly includes any uneven surface that prevents the transparent cap from appearing plain. The lens elements are generally convex lenses or concave lenses; however, the invention is not limited to these particular implementations. In other words, these lens elements may include prisms, grooves, ribs, or an uneven surface formed by frosting.

As described above, in the vehicle lamp of the invention, in order to emit a colored light beam, the light bulb is either a colored light bulb, covered with a colorless transparent cap which has a plurality of lens elements, or a transparent cap whose color is lighter than the color of the light bulb. Hence, even if the lens is colorless and transparent, the vehicle lamp is still able to emit a colored light beam. Therefore, the lamp appears deep and glittering. In addition, the transparent cap has a plurality of lens elements. This feature prevents the colored bulb from appearing as it is, and reduces the contrast of the colored light bulb and the reflecting surface of the reflector, which shines white.

When a colorless transparent cap is used, the color of the light bulb should be set to a color that is the same as the colored lighted beam to be emitted. On the other hand, if the color of the transparent cap is set to a color that is lighter than the color of the light bulb, the color of the light bulb is determined by taking into consideration the apparent change in color that occurs when the light beam passes through the transparent cap. The colored bulb, the transparent cap, and reflector's reflecting surface appear white, which reduces the contrast.

As is apparent from the above description, the vehicle lamp designed to emit a colored light beam looks attractive in appearance when it is off.

The lens described above may be designed so that its whole surface is formed into lens-like steps. It may also have a plain portion, which allows the lamp to appear deeper and more glittering. Thus, the transparent cap having a plurality of lens elements also prevents the colored bulb from being perceived by the eye as it really is.

The reflector may have only a single reflecting surface. However, a plurality of reflecting surfaces is preferable, because the plurality of lens elements of the transparent cap is projected onto each of the reflecting surfaces of the reflector so that the vehicle lamp appears more glittering.

Furthermore, an opening may be formed in the transparent cap located above the light bulb. In this case, the heat generated by the light bulb can flow out of the transparent cap through the opening. This will prevent the transparent cap from being deformed by heat.

The plurality of lens elements are formed on an inner surface of the cylindrical portion of the transparent cap, which is shaped into a plurality of lens elements extended in the direction of the optical axis. Thus, when the vehicle lamp is observed from a direction perpendicular to the optical axis, the colored light bulb inside the transparent cap is barely visible.

In addition, the plurality of lens elements have the inner surface of the front end portion of the transparent cap formed into a Fresnel lens, and the outer surface of the front end portion divided into a plurality of segments, and at least some of the segments are diffusion lens elements. In this case, the direct light beam emitted forward from the light bulb may be utilized for lamp light distribution.

Furthermore, the color of the light bulb may be amber with the transparent cap being colorless. This type of vehicle lamp may be employed as a front turn signal lamp or the like.

An embodiment of the invention will now be described with reference to the accompanying drawings.

Figure 2:
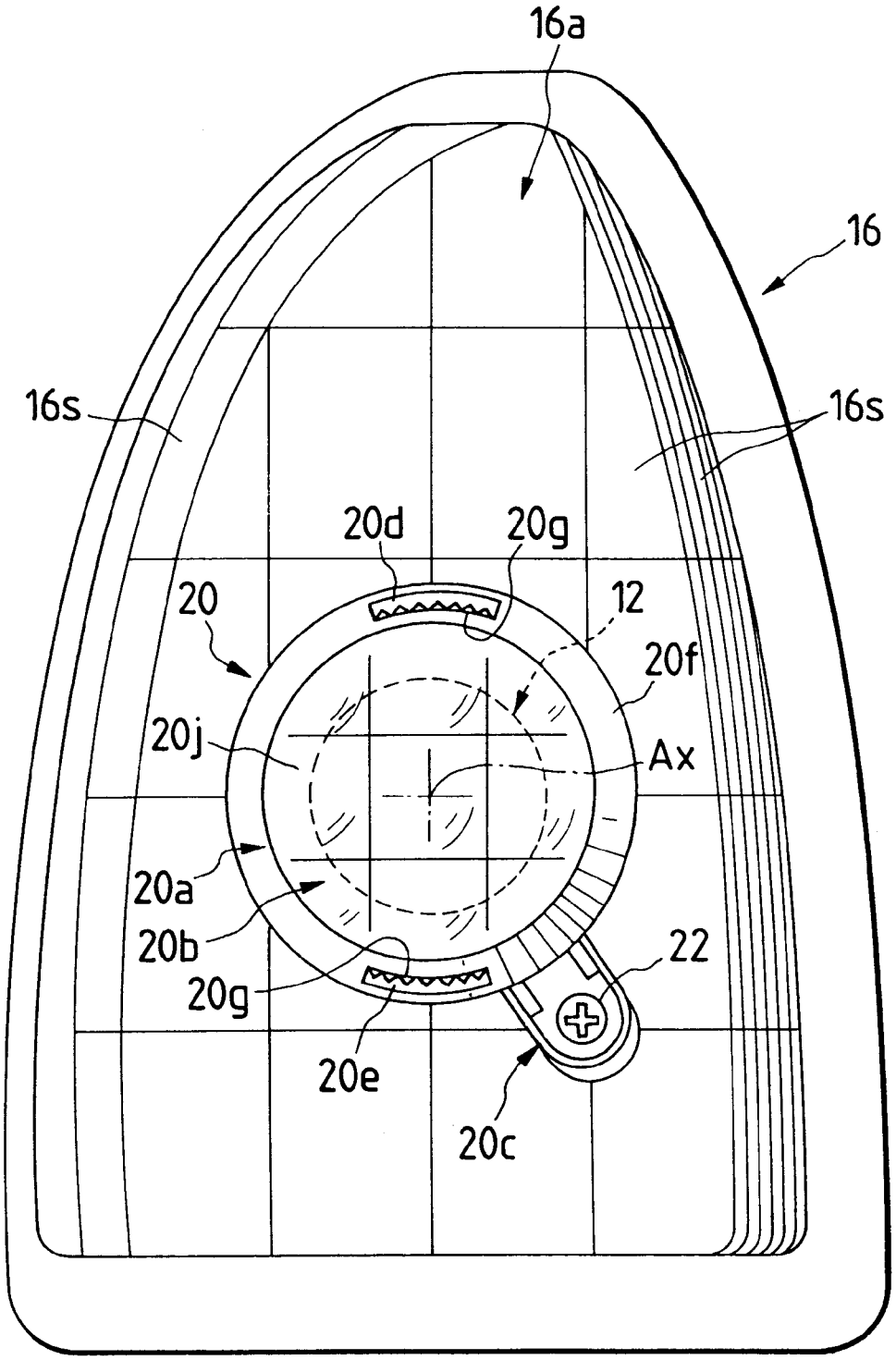
FIG. 2 is a diagram showing the vehicle lamp as viewed in the direction of the arrow II in FIG. 1.
Figure 3:
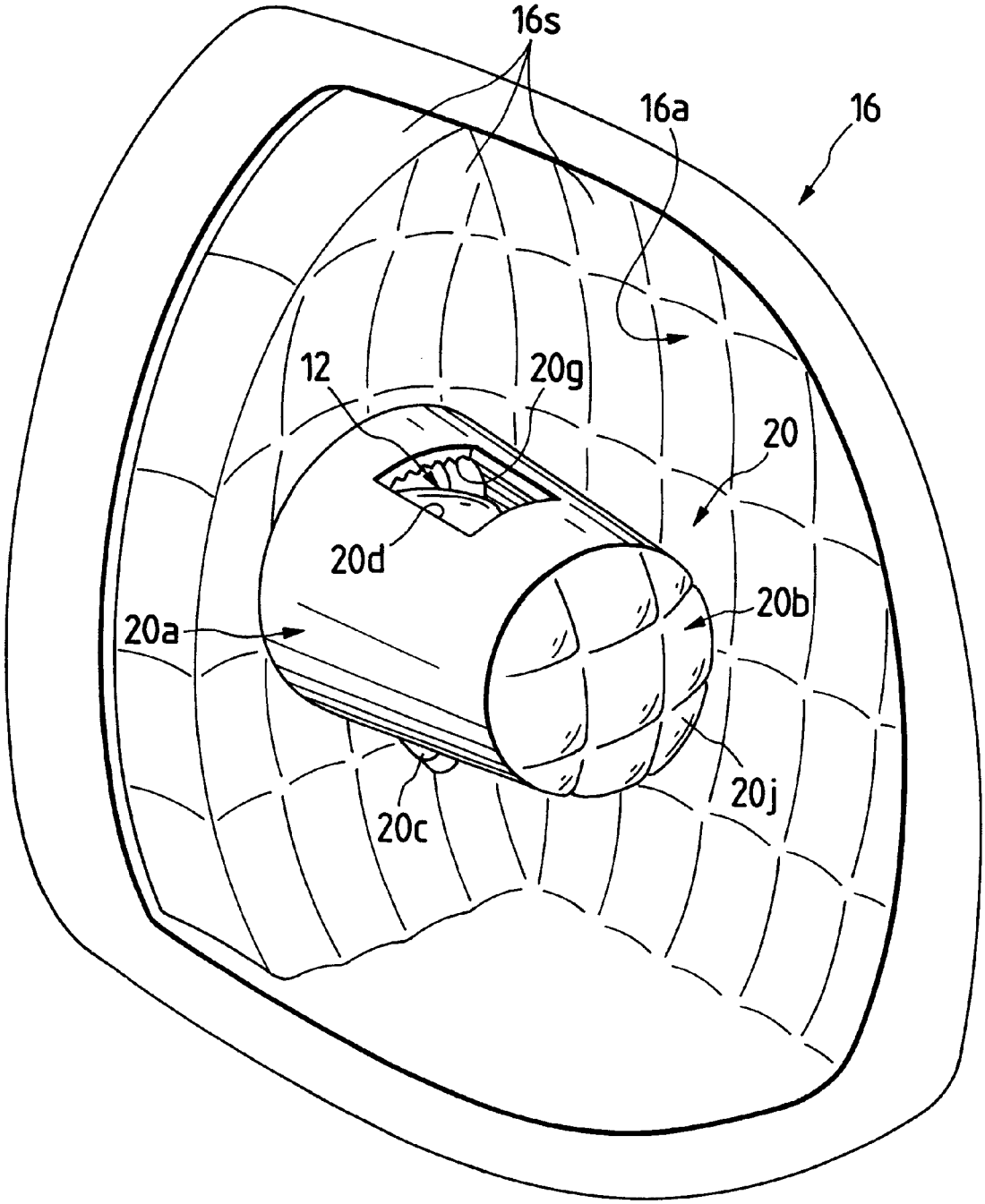
FIG. 3 is a diagram showing the vehicle lamp with the lens removed as viewed in the direction of the arrow III in FIG. 1.
Figure 4:
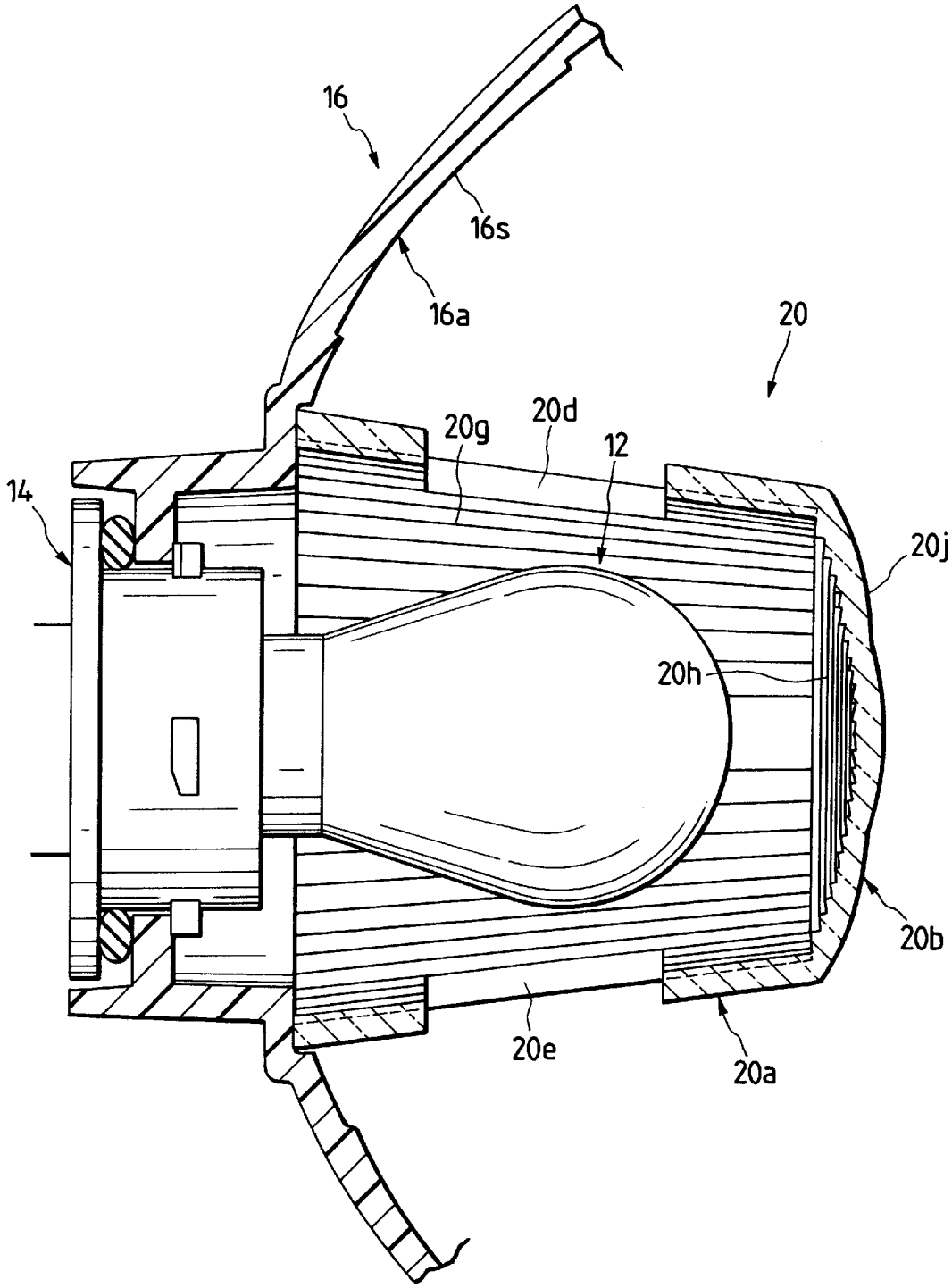
FIG. 4 is an enlarged sectional view taken along line IV—IV in FIG. 1.

FIG. 1 is a sectional plan view showing a preferred embodiment of the invention. FIG. 2 is a diagram showing the vehicle lamp with its lens removed as viewed in the direction of the arrow II, and FIG. 3 is also a diagram showing the vehicle lamp with its lens removed as viewed in the direction of the arrow III. FIG. 4 is an enlarged sectional view taken along line IV—IV.

As shown in FIG. 1, a vehicle lamp 10 is a front turn signal lamp that is located at right front corner of the vehicle body and emits an amber light beam. The lamp 10 includes a light bulb 12, a reflector 16 that supports the bulb 12 with the aid of a socket 14 and reflects light emitted from the light bulb 12, a lens 18 that is placed in front of the reflector 16 and whose periphery is welded to the reflector 16, and a transparent cap 20 that is attached to the reflector so as to cover the light bulb 12.

The light bulb 12 is an amber light bulb, having an optical axis Ax that is extended in the front-to-rear direction of the vehicle body.

The reflector 16 has an inner surface that is formed into a reflecting surface 16*a* by aluminum vacuum deposition. The reflecting surface 16*a* is divided into segments, namely, a plurality of reflecting surface elements 16*s* that are substantially in the form of a grid.

The lens 18 is a colorless, transparent, plain lens.

The transparent cap 20 is made of colorless, transparent polycarbonate resin. The transparent cap 20 is in the form of a cup. The transparent cap 20 includes a cylindrical portion 20*a* that surrounds the optical axis Ax of the bulb 12, a front end portion 20*b* that closes the front opening of the cylindrical portion 20, and a tab 20*c* extended outwardly from the rear opening of the cylindrical portion 20*a* (see FIG. 2). With the rear end opening of the transparent cap 20 correctly abutted against the reflector 16, the transparent cap 20 is secured to the reflector 16 with a screw 22.

An opening 20*d* and an opening 20*e* are formed in the upper part (above the bulb) and the lower part (below the bulb) of the cylindrical portion 20*a* of the transparent cap 20.

The inner surface of the cylindrical portion 20*a* of the transparent cap 20 is formed into a side step 20*g*, which is in the form of a plurality of convex lenses arranged at short intervals and extended along the optical axis Ax.

In addition, as shown in FIG. 4, the inner surface of the front end portion 20*b* of the transparent cap 20 is formed into a Fresnel lens 20*h*. The outer surface of the front end portion 20*b* is formed into a plurality of fisheye lenses that are arranged in the form of a grid.

The front turn signal lamp 10 emits an amber light beam. For this purpose, the light bulb 12 is an amber light bulb covered with the colorless, transparent cap 20. The lens 18 is a colorless, transparent, plain lens. Hence, the reflecting surface 16*a* formed by aluminum vacuum deposition looks glittering through the lens 18. Therefore, the lamp appears deep and bright.

As described above, the inner surface of the cylindrical portion 20*a* of the transparent cap is formed into side steps 20*g*, which are in the form of a plurality of convex lenses arranged at short intervals and extended along the optical axis Ax. Therefore, when viewed from the side, the amber light bulb inside the transparent cap 20 barely can be seen.

In addition, the inner surface of the front end portion 20*b* of the transparent cap 20 is formed into a Fresnel lens 20*h*, and the outer surface of the front end portion 20*b* is formed into a plurality of fisheye lenses, which are arranged in the form of a grid. Therefore, when the lamp is observed from the front, the amber light bulb 12 behind the transparent cap 20 is barely seen. Moreover, if a light beam emitted in the forward direction from the light bulb 12 is converted into a parallel light beam and diffused at a predetermined angle, the light beam can be utilized for lamp light distribution.

It is apparent from the above description that the transparent cap 20 prevents the light bulb 12 from being seen as it is, and reduces the contrast of the amber light bulb 12 and the reflecting surface 16*a* (formed by aluminum vacuum deposition) of the reflector 16, which shines white. This improves the appearance of the lamp when the lamp is off. In addition, the transparent cap 20 may also have a light distribution function.

Furthermore, the reflecting surface 16 of the reflector, which is formed by aluminum vacuum deposition, is shaped into a plurality of reflecting surface elements 16*s*. Therefore, the lamp appears more glittering.

The opening 20*d* is formed in the portion of the transparent cap 20, which is located above the light bulb. Therefore, heat generated by the light bulb can flow out of the transparent cap 20. This feature prevents the transparent cap 20 from being deformed by heat. In addition, the opening 20*e* is formed in a portion of the transparent cap 20 that is located below the light bulb. This opening 20*e* serves as an air inlet, so that the heat in the transparent cap 20 is radiated away with high efficiency. Thus, thermal deformation of the transparent cap 20 can be more effectively prevented.

While the invention has been described in detail and with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A vehicle lamp comprising:

a colored light bulb;

a reflector reflecting light emitted from the light bulb;

a lens positioned in front of the reflector on a closed end of a transparent cap, the transparent cap being attached to the reflector and covering a portion of the reflector, wherein the transparent cap is lighter in color than the light bulb; and the transparent cap further comprising a plurality of lens elements.

2. The vehicle lamp of claim 1, wherein the lens comprises a plain portion.

3. The vehicle lamp of claim 1, wherein the reflector comprises a plurality of reflecting surface elements.

4. The vehicle lamp of claim 3, wherein the transparent cap further comprises a first opening located above the light bulb and a second opening located below the light bulb.

5. The vehicle lamp of claim 3, wherein the transparent cap further comprises a cylindrical portion surrounding the light bulb, and wherein an inner surface of the cylindrical portion is shaped into a plurality of lens elements extended in a direction of an optical axis of the light bulb.

6. The vehicle lamp of claim 3, wherein the transparent cap further comprises a front end portion covering the light bulb, the front end portion having an inner surface and an outer surface, wherein the inner surface of the front end portion is shaped into a Fresnel lens, the outer surface of the front end portion is divided into a plurality of segments, and at least some of the plurality of the segments are formed into diffusion lens elements.

7. The vehicle lamp of claim 1, wherein the transparent cap further comprises a cylindrical portion surrounding the light bulb, and wherein an inner surface of the cylindrical portion is shaped into a plurality of lens elements extended in a direction of an optical axis of the light bulb.

8. The vehicle lamp of claim 7, wherein the transparent cap further comprises a front end portion covering the light bulb, the front end portion having an inner surface and an outer surface, the inner surface of the front end portion is shaped into a Fresnel lens, the outer surface of the front end portion is divided into a plurality of segments, and at least some of the plurality of the segments are formed into diffusion lens elements.

9. The vehicle lamp of claim 1, wherein the transparent cap further comprises a front end portion covering the light bulb, the front end portion having an inner surface and an outer surface, wherein the inner surface of the front end portion is shaped into a Fresnel lens, the outer surface of the front end portion is divided into a plurality of segments, and at least some of the plurality of the segments are formed into diffusion lens elements.

10. The vehicle lamp of claim 1, wherein the transparent cap is fully colorless.

11. The vehicle lamp of claim 1, wherein the transparent cap has a lighter color than the light bulb.

12. The vehicle lamp of claim 1, wherein the transparent cap has a color being the same in hue as the light bulb and is lighter in color than the light bulb.

13. The vehicle lamp of claim 1, wherein the transparent cap has a color different in hue from the light bulb and is lighter in color than the light bulb.

14. The vehicle lamp of claim 1, wherein an inner surface of the transparent cap includes a plurality of convex lenses extended along an optical axis of the transparent cap.

15. The vehicle lamp of claim 1, wherein the plurality of lens elements comprise fisheye lenses on an outer surface of the transparent cap.

16. A vehicle lamp comprising:

a colored light bulb;

a reflector behind the light bulb and having a plurality of reflecting surfaces arranged on a grid, the reflector reflecting light emitted from the light bulb;

a lens positioned in front of the reflector on a closed end of a transparent cap, the transparent cap being attached to the reflector and covering the light bulb and a portion of the reflector, wherein the transparent cap is lighter in color than the light bulb; and the transparent cap further comprising a plurality of lens elements.

17. The vehicle lamp of claim 16, wherein the transparent cap further comprises a first opening located above the light bulb and a second opening located below the light bulb.

18. The vehicle lamp of claim 16, wherein the transparent cap further comprises a front end portion covering the light bulb, the front end portion having an inner surface and an outer surface, the inner surface of the front end portion is shaped into a Fresnel lens, and the outer surface of the front end portion is divided into a plurality of segments.

19. A vehicle lamp comprising:

a colored light bulb;

a reflector reflecting light emitted from the light bulb;

a lens positioned in front of the reflector on a closed end of a transparent cap, the transparent cap being attached to the reflector and covering the light bulb and a portion of the reflector, wherein the transparent cap is lighter in color than the light bulb;

a first opening in the transparent cap above the light bulb;

a second opening in the transparent cap directly below the light bulb; and the transparent cap further comprising a plurality of lens elements.

20. The vehicle lamp of claim 19, wherein the transparent cap further comprises a front end portion covering the light bulb, the front end portion having an inner surface and an outer surface, the inner surface of the front end portion is shaped into a Fresnel lens, and the outer surface of the front end portion is divided into a plurality of segments.

* * * * *